US006685530B1

(12) United States Patent
Rehkemper et al.

(10) Patent No.: US 6,685,530 B1
(45) Date of Patent: Feb. 3, 2004

(54) TOY FIGURE WITH COMBINED ACTIVATION

(75) Inventors: Steven Rehkemper, Chicago, IL (US); Dan Bryce, Chicago, IL (US); Dennis O'Patka, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 10/370,994

(22) Filed: Feb. 24, 2003

(51) Int. Cl.[7] ..... A63H 30/00

(52) U.S. Cl. ..... 446/175; 446/132; 446/139; 446/298; 446/330; 446/352; 434/393

(58) Field of Search ..... 446/175, 132, 446/130, 129, 137–139, 297–299, 301, 330, 304, 351–354, 484, 391, 397, 302; 434/169, 322, 335, 393

(56) References Cited

U.S. PATENT DOCUMENTS 1,551,050 A * 8/1925 Parsons ..... 446/139
2,427,442 A * 9/1947 Campbell ..... 446/132
3,411,237 A * 11/1968 Crossman ..... 446/132
3,672,096 A * 6/1972 Johmann ..... 446/338
5,071,385 A * 12/1991 Cox ..... 446/129
5,501,627 A * 3/1996 Ekstein ..... 446/175

FOREIGN PATENT DOCUMENTS

GB 2196545 A * 5/1998 ..... A63H/3/36

* cited by examiner

*Primary Examiner*—Jacob K. Ackun
*Assistant Examiner*—Bena B. Miller

(57) ABSTRACT

In accordance with one embodiment of the present invention there is provided a toy figure having a circuit board to store pre-recorded sounds, a speaker to emit the pre-recorded sounds, and a means to activate the playback of said pre-recorded sounds. The figure also includes a plurality of sensors separately positioned about the figure at specific locations; each sensor when triggered activates the playback of pre-recorded sounds indicative of the location. A first arm having a hand attached thereto includes a magnet that when in proximity to one of the sensors triggers said sensor, whereby a user moving the hand with the magnet to a location on the figure containing a sensor, the figure plays pre-recorded sounds indicative of the location.

18 Claims, 5 Drawing Sheets

TOY FIGURE WITH COMBINED ACTIVATION

FIELD OF THE INVENTION

The present invention relates to a toy figure with various pre-recorded audio sounds that are played upon the activation of one or more sensors or switches.

BACKGROUND OF THE INVENTION

Toy figures have always been the mainstay as toys for young children. Included therewith, are figures that when activated by a user talk or sing in response thereto. For example, in some instances a switch may be placed within the figure that when pressed causes the toy figure to emit various sounds or noises. In yet other figures, the figure will respond when a magnetic material, placed in another object, is in proximity to a magnetically activated sensor within the toy figure, such as in U.S. Pat. No. 5,603,652, and in commonly assigned U.S. patent application Ser. No. 10/307,578, filed on Dec. 02, 2002.

Nevertheless, there is always a continual need for improvements and novel features not found in the prior art. For example, the ability to provide a figure that includes multiple triggering means to activate sensors and switches that invoke various responses when activated separately and invoke different or surprise responses when invoked in concert or in combination with each other. Moreover, further improvements may be made to provide a toy figure that play sound sequential audio bites that are invoked by repeatedly activating a triggering means, such that each activation of the triggering means causes the next sequential sound bite to play.

SUMMARY OF THE INVENTION

In one embodiment of the present invention there is provided a toy figure, which includes a torso and at least a pair of arms with hands. The toy figure further includes a circuit board to store pre-programmed audio outputs and a speaker to emit the pre-programmed audio outputs. The toy figure also includes various switches and sensors positioned at different locations inside of the toy figure, which when activated cause the toy figure to emit various pre-programmed audio outputs. One of the triggering means is preferably a magnet embedded in one of the toy figure's hand, such that when the hand is positioned in proximity to one of a plurality of magnetically activated sensors, the sensor is activated causing the circuit board to playback and emit through the speaker pre-recorded audio outputs or sounds. The pre-recorded sounds may or may not be indicative of the location of the activated magnetically activated sensor.

In another aspect of the invention, the toy figure also includes a level switch positioned under the other arm. The level switch is also adjacent to a magnetically activated switch. The level switch is activated when the arm is pushed downwardly towards the torso. In this instance, an audio output is played only when both the level switch and the magnetically activated sensor located by the level switch are activated. In addition, when the magnetically activated switch is triggered and the level switch is repeatedly triggered, the circuit board plays a tune in sequential sound bites, where each sound bite is equated to a single triggering of the level switch.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein:

FIG. 4*c* is a perspective view of the toy figure showing the triggering means positioned in proximity to the sensor using a transmitter and receiver.

DETAILED DESCRIPTION OF THE DRAWINGS

Figure 1:
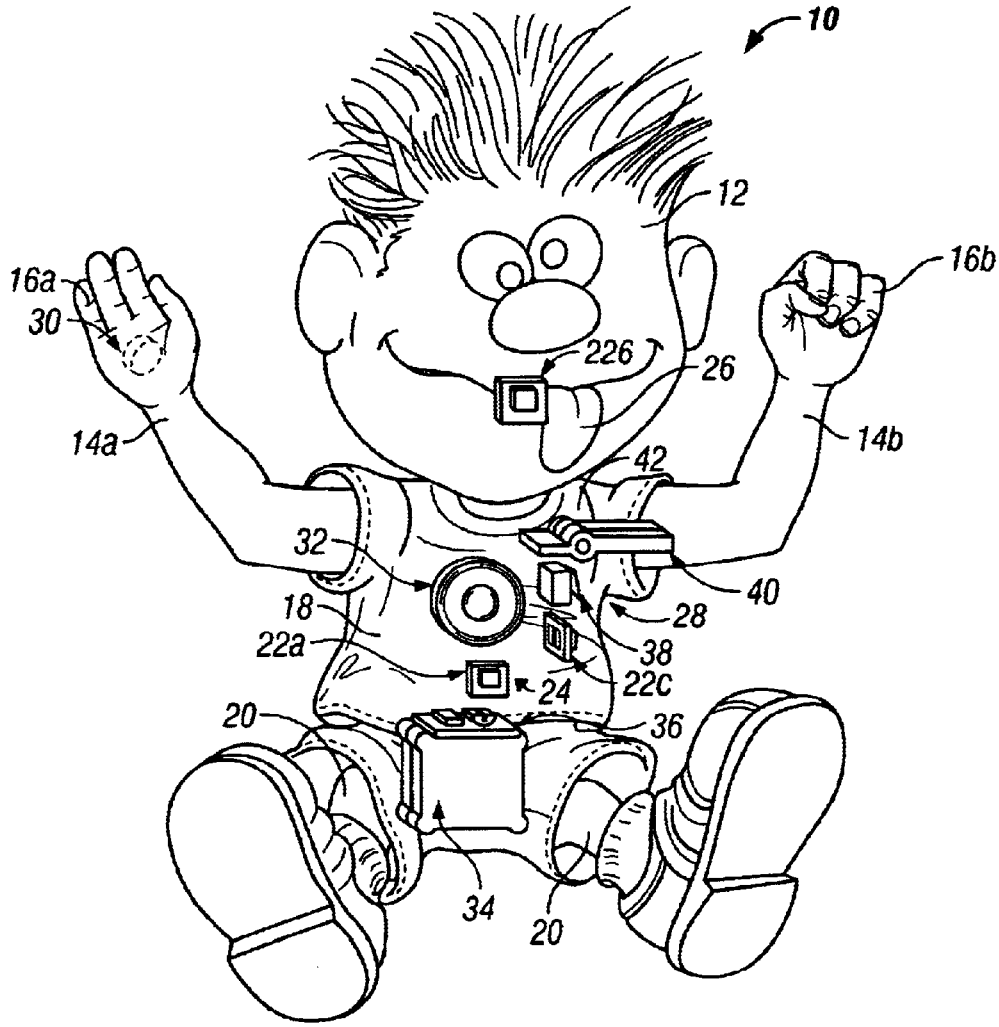
FIG. 1 is a front view of the present invention illustrating a toy figure and various internal components, showing at least the various possible locations for sensors and a triggering means in one of the figure's hand.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated. 1131 Referring now to FIG. 1, a toy FIG. 10 is illustrated along with various internal components. While depicted throughout the drawings as a toy doll, the actual external configuration of the toy FIG. 10 is not material to the scope of the invention. The toy figure may have any configuration along with any number of appendages with or without extremities attached thereto. For example, one can image an toy figure configured as an animal with five appendages (four legs and a tail) and four extremities attached separately to four of the five appendages (each leg having a paw).

The FIG. 10 in accordance to FIG. 1 includes a head 12, a pair of arms 14 with hands 16 (referred to as a first arm 14*a* with a first hand 16*a* and a second arm 14*b* with a second hand 16*b*); a torso 18 and a pair of legs 20. The FIG. 10 further includes a plurality of magnetically activated sensors 22 (such as hall-effect sensors) positioned at various locations within the FIG. 10. For example, the FIG. 10 includes a first sensor 22*a* positioned in the torso 18 (located approximately by the figure's tummy 24), a second sensor 22*b* positioned in the head 12 (located approximately by the figure's mouth 26); and a third sensor 22*c* positioned under the second arm 14*b* (located approximately in the armpit area 28). A trigger 30, such as a magnet, is located in the first hand 16*a* and when the magnet 30 is positioned in proximity to a magnetically triggered sensor 22, the sensor 22 is triggered. However, other types of sensors or receiving means may be used that are capable of being triggered by a corresponding triggering or transmitting means.

The FIG. 10 also includes a speaker 32. The various components described herein are powered and controlled by a power source 34 (such as a replaceable or rechargeable battery pack) and a circuit board with an appropriate sound chip generally referenced as 36. The sound chip is used to store various pre-recorded sounds. To turn the FIG. 10 on a user may switch an on/off switch (not shown).

In addition to the above triggering means 30 and sensors 22, the toy figure may also include a lever switch 38 positioned about the third sensor 22*c* in the figure's armpit area 28. A shoulder joint trigger 40 positioned in the shoulder joint region 42 in the second arm 14*b*, activates the lever switch 38 when the second arm 14*b* is lowered towards the torso 18. The second arm 14*b* may also be normally disposed in a raised position allowing the lever switch 38 to be normally in an off position.

Figure 2:
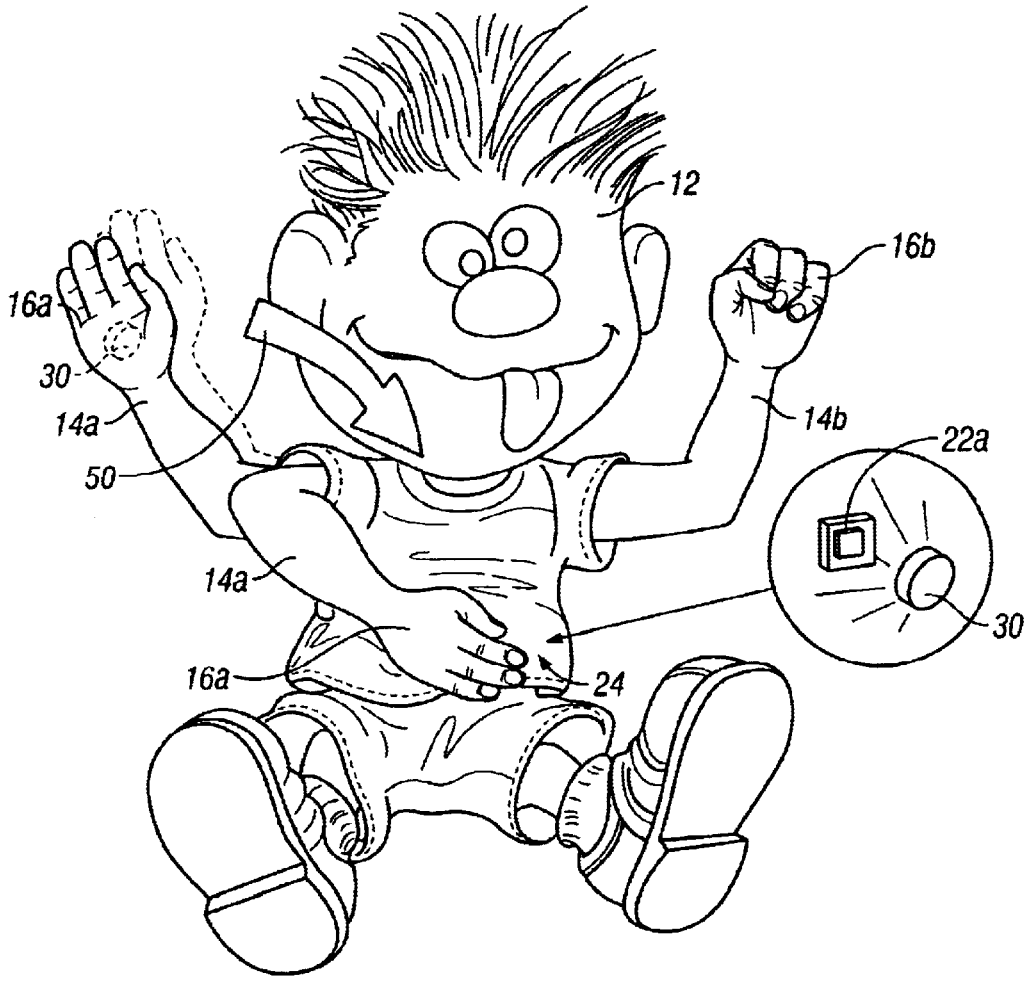
FIG. 2 is a perspective view of the toy figure showing the triggering hand positioned in proximity to the sensor located in the figure's tummy.
Figure 3:
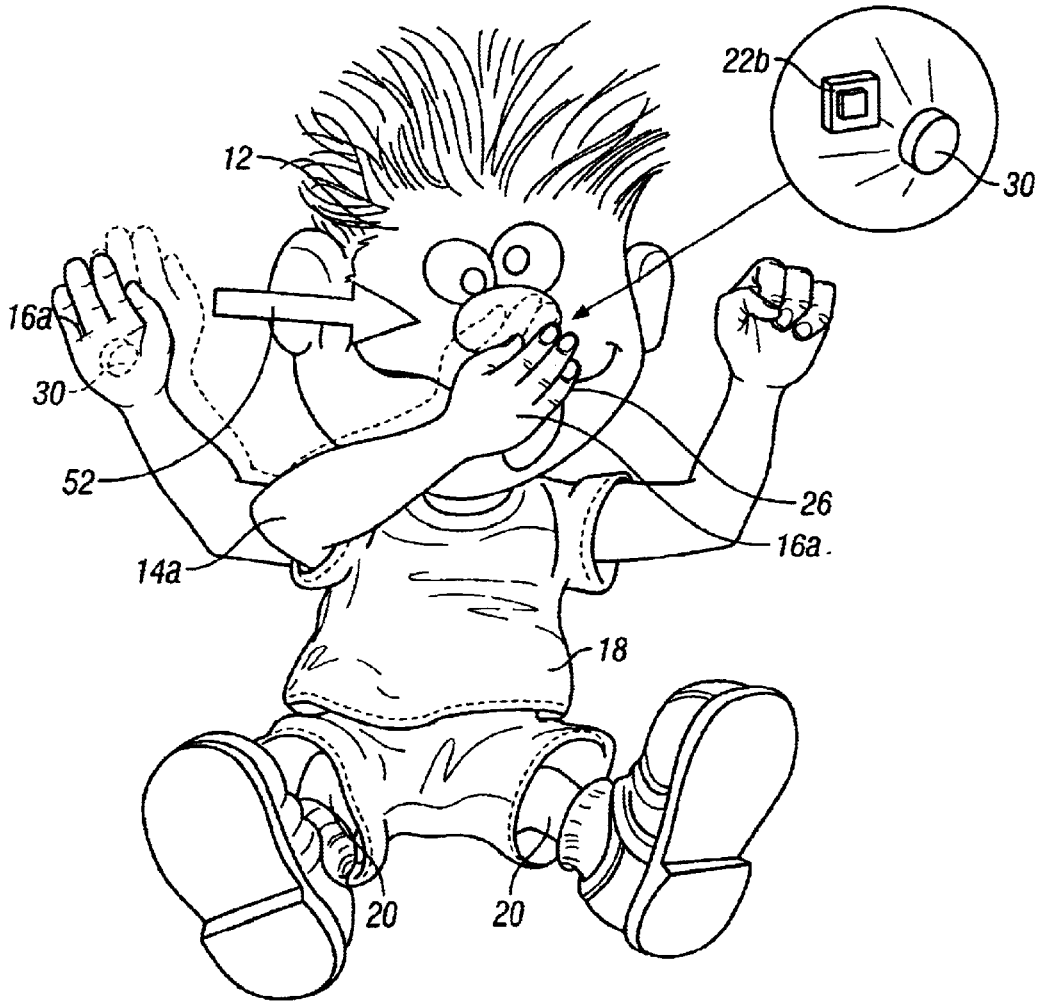
FIG. 3 is a perspective view of the toy figure showing the triggering hand positioned in proximity to the sensor located in the figure's mouth.

Referring now also to FIGS. 2–4, when the figure is turned on, and the magnet 30 is moved in proximity to one of the magnetically triggered sensors 22, the sensor is activated. When a sensor is triggered, the circuit board 36 activates to cause the pre-recorded audio sounds to emit through the speaker 32. In addition, the played pre-recorded audio sounds may also be indicative of the activated sensor. This is accomplished by having the circuit board 36 recognize not only that a sensor is triggered but also which sensor is triggered. As such, a user moving the first hand 16*a*, with the magnet 30 contained therein, in proximity to a magnetically triggered sensor 22 triggers pre-programmed sounds.

For example and referring specifically to FIG. 2, when the first hand 16*a* is moved in proximity to the first sensor 22*a*, located by the tummy 24 and indicated by arrow. 50, the FIG. 10 may emit a pre-recorded sound, such as "I am hungry." Referring specifically to FIG. 3, when the first hand 16*a* is moved in proximity to the second sensor 22*b*, located by the mouth 26 and indicated by arrow 52, the FIG. 10 may emit another pre-recorded sound, such as "That was good food" and then the FIG. 10 may emit a burping noise.

Figure 4A:
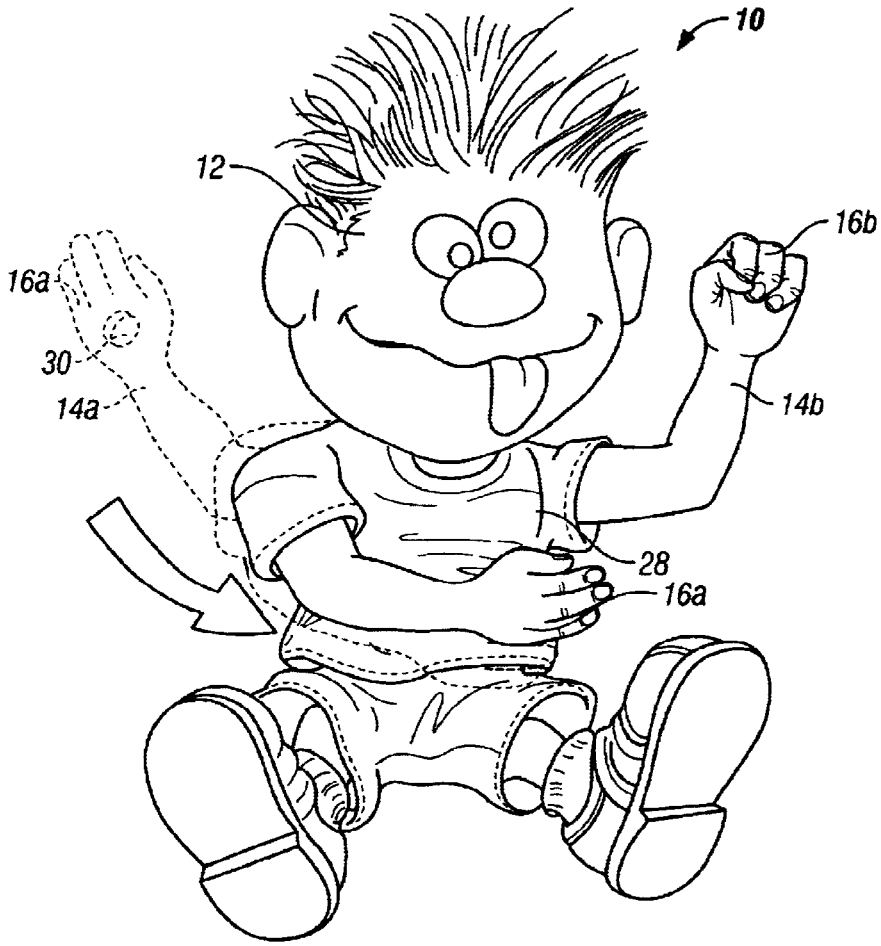
FIGS. 4*a*–4*b* are perspective views of the toy figure showing the triggering hand positioned in proximity to the sensor located under the opposite arm; and showing the opposite arm moving upwardly and downwardly to activate a switch in the opposite arm.
Figure 4B:
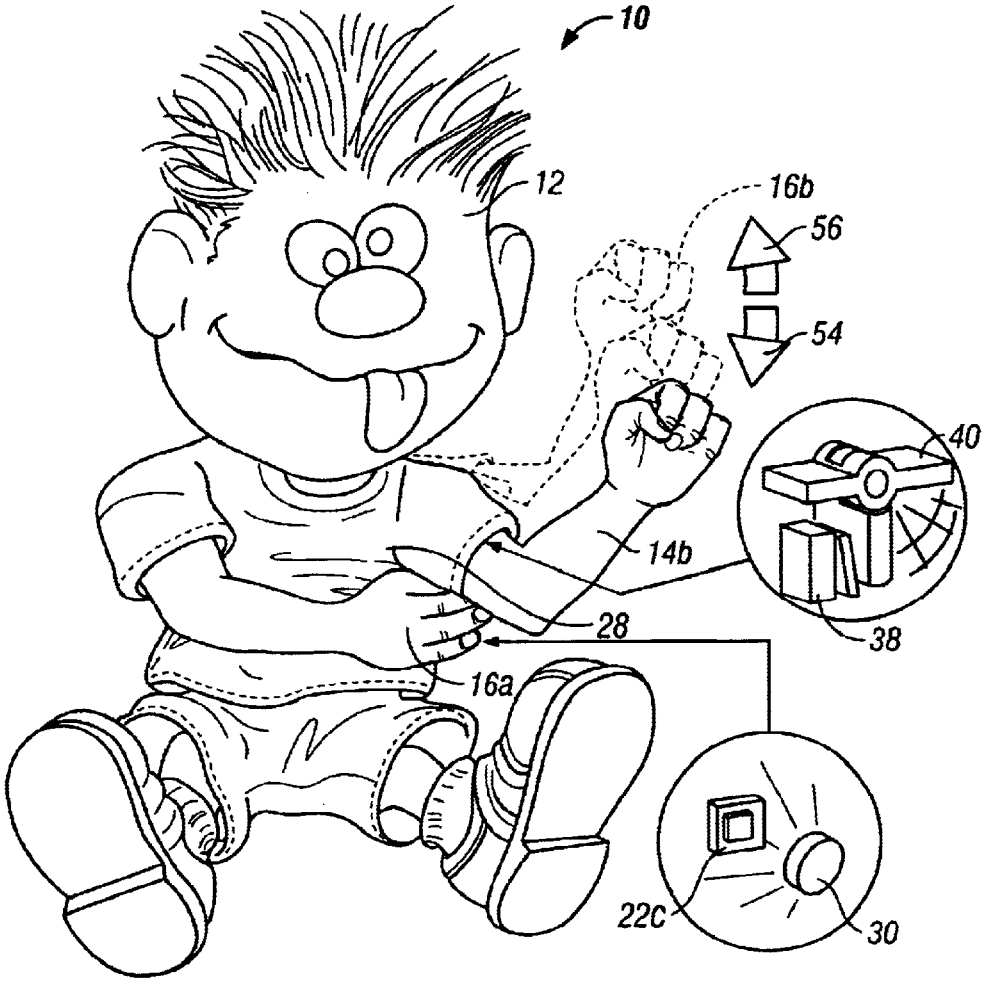

Specifically referring to FIGS. 4*a* and 4*b* and in another example, the first hand 16*a* is moved to the armpit area 28 and in proximity to the third sensor 22*c*, indicated by arrow 56. The initial triggering of the third sensor 22*c* may activate an initial pre-recorded sound such as "Would you like me to play a song." To play the pre-recorded song or audio sample, the user would move the second arm 16*b* downwardly and upwardly indicated by arrows 54 and 56 repeatedly, causing the lever switch 38 to trigger the shoulder joint trigger 40 repeatedly. Working in concert together, the activation of the third sensor 22*c* and the activation of the lever switch 38 a single time may activate the playback of a single sound effect, such as armpit noises typically made by children. However, when the user repeats the triggers of the shoulder joint trigger 40, the figure may play sequential sound bites, each sound bite equating to a single trigger of the shoulder joint trigger 40. The sequential sound bites may be a song generated with the sound effect of the same raspberry sound children make with their armpit. Thus, the user will hear a song as the user continues to trigger the lever switch 38 and as long as the third sensor 22*c* (in the armpit 28) was maintained throughout the triggering of the lever switch 38.

In yet another embodiment of the present invention, the circuit board includes a plurality of programmed play tunes or songs in sequential sound bites. To activate the playback of different songs in the sequential sound bites, a user must trigger two sensors in concert. For example, as mentioned above, when the first hand 16*a* is positioned over the mouth 26, the circuit board 36 plays back a burping noise. However, if the user then repeatedly moved the second arm 14*b* towards the torso 18 continually triggering the lever switch 38, the circuit board plays a sound bit (or note) of the song for each triggering of the lever switch 38. Thus, the user will hear a song, preferably in a burping sound effect, as the user continues to trigger the lever switch 38 and as long as the second sensor 22*b* (in the mouth 26) was maintained throughout the triggering of the lever switch 38. The lever switch 38 may also be replaced by a squeeze switch located in the tummy region 24. This embodiment may also include similar playback when the third switch 22*c* in the armpit 28 was triggered by the magnet 30 and the second arm 14*b* was repeatedly moved towards the torso 18. In this example, the circuit board 36 will play a different song with a sound effect indicative of the area If during the playback of the song, the user moves the first hand 16*a* and breaks contact or the triggering of a sensor 22, the song sequence will go back to the beginning or may go to another song.

Furthermore, it is also possible to reverse the locations of the triggering means and the sensors, especially if the triggering means is a transmitter and the sensors are receivers. In this instance, the first hand 16*a* contains a receiver 60 and the body of the figure contains multiple transmitters 62 set to transmit a different signal The circuit board would also be capable of distinguishing the signals in order to playback specific pre-recorded sounds set for each signal, such that the playback of pre-recorded sounds could still be indicative of the location of the transmitter.

From the foregoing and as mentioned above, it is observed that numerous variations and modifications may be effected without departing from the spirit and scope of the novel concept of the invention. For example, the figure may generally include a plurality of appendages with extremities attached thereto. One or more of the extremities may include triggering means that when brought in proximity to a sensor, within the figure, activates the sensor to cause the playback of pre-recorded sounds. The figure as such may include a second magnet switch in the foot.

It is to be understood that no limitation with respect to the embodiments illustrated herein is intended or should be inferred. It is intended to cover, by the appended claims, all such modifications within the scope of the appended claims.

We claim:

1. A toy figure having a torso and a first appendage extending therefrom, the figure further comprising:

a sensor positioned about the toy figure, a circuit board to store pre-programmed sounds, a speaker to emit the pre-programmed sounds when the sensor is triggered, and a triggering means positioned in said appendage, the triggering means when in proximity to said sensor, triggers said sensor such that the figure emits a pre-programmed sound, wherein the triggering means is defined as a magnet and the sensor is defined as a hall-effect sensor.

2. The toy figure according to claim 1 further comprising:

a second appendage extending from said torso;

a lever switch positioned in the torso and in proximity to the second appendage;

a lever positioned in the second appendage such that when the second appendage is moved towards the torso, the lever triggers the lever switch to send a signal to the circuit board; and a hall-effect sensor positioned in proximity to the lever switch and triggers when the magnet in the first appendage is in proximity to the sensor, wherein the triggering of both said hall-effect sensor and the lever switch in concert activates the figure to emit a pre-recorded sound.

3. The toy figure of claim 2, wherein the circuit board stores a pre-recorded audio sample in sound bites stored on the circuit board sequentially and the triggering of said hall-effect sensor and the lever switch activates the figure to emit one of said sound bites, and the subsequent triggering of the lever switch while the triggered hall effect sensor is maintained to cause the circuit board to emit a sound bit stored sequentially after a previously emitted sound bit, whereby the pre-recorded audio sample is emitted when the hall effect sensor is triggered and maintained and the lever switch is repeatedly triggered in concert.

4. The toy figure according to claim 1 further comprising a switch located within the figure that when triggered in concert with the triggering of said sensor activates the figure to emit a pre-programmed sound.

5. The toy figure of claim 4, wherein the circuit board stores a pre-recorded audio sample in sound bites stored on the circuit board sequentially and the triggering of said sensor and the lever switch activates the figure to emit one of said sound bites, and the subsequent triggering of the lever switch while the triggered sensor is maintained to cause the circuit board to emit a sound bit stored sequentially after a previously emitted sound bit, whereby the pre-recorded audio sample is emitted when the sensor is triggered and maintained and the lever switch is repeatedly triggered in concert.

6. A toy figure comprising:

a circuit board to store pre-recorded sounds, a speaker to emit the pre-recorded sounds, and a means to activate the playback of said pre-recorded sounds;

a plurality of sensors separately positioned about the figure at specific locations, each sensor of said plurality of sensors when triggered activates the playback of pre-recorded sounds indicative of said specific location; and a first appendage having an extremity attached thereto, the extremity includes a triggering means that when in proximity to one sensor of the plurality of sensors triggers said one sensor, whereby the figure plays pre-recorded sounds indicative of specific locations of the figure when said extremity is moved in proximity to a sensor of the plurality of sensors positioned in said specific locations.

7. The figure according to claim 6 further comprising a head having a mouth, and said mouth having a sensor of the plurality of sensors that when triggered activates the playback of pre-recorded sounds indicative of said mouth.

8. The figure according to claim 6 further comprising a torso and said torso having a sensor of the plurality of sensor positioned in a lower portion of said torso that, when triggered activates the playback of pre-recorded sounds indicative of said lower portion of said torso.

9. The figure according to claim 8 further comprising:

a second appendage attached to the torso and having a sensor of the plurality of sensors positioned between said second appendage and said torso defined as an upper torso sensor that is triggered when the extremity is in proximity to said upper torso sensor; and a switch positioned between said second appendage and said torso and a triggering means in said second appendage that triggers said switch when said second appendage is moved towards the torso, whereupon the triggering of said upper torso sensor positioned between the second appendage and the torso and the triggering of said switch activates the playback of pre-determined and pre-recorded sounds.

10. The toy figure according to claim 9, wherein the circuit board stores a pre-recorded audio sample in sound bites stored on the circuit board sequentially and the triggering of said upper torso sensor and the lever switch activates the figure to emit one of said sound bites, and the subsequent triggering of the lever switch while the triggered upper torso sensor is maintained to cause the circuit board to emit a sound bit stored sequentially after a previously emitted sound bit, whereby the pre-recorded audio sample is emitted when the upper torso sensor is triggered and maintained and the lever switch is repeatedly triggered in concert.

11. The toy figure according to claim 9, wherein the triggering means is a magnet and the upper torso sensor is a hall-effect sensor.

12. A toy figure comprising:

a circuit board to store pre-recorded sounds indicative to a specific location on the figure and a speaker to emit the pre-recorded sounds, the circuit board and speaker contained within the figure;

a first arm connected to a torso and having a hand extending from the first arm, the hand having a triggering means that when in proximity to a sensor causes the activation of said sensor;

a second arm connected to the torso at a shoulder region, the torso containing a switch positioned about the shoulder region and the shoulder region containing a lever that triggers the switch when the second arm is moved towards the torso; and a upper torso sensor positioned in the torso about the second arm and is triggered when the hand attached to the first arm is moved in proximity to said upper torso sensor, wherein the triggering of both the upper torso sensor and the switch activates a playback of pre-recorded sounds indicative of the position of the upper torso sensor.

13. The toy figure of claim 12, wherein the circuit board stores a pre-recorded audio sample in sound bites stored on the circuit board sequentially and the triggering of said upper torso sensor and the lever switch activates the figure to emit one of said sound bites, and the subsequent triggering of the lever switch while the triggered upper torso sensor is maintained to cause the circuit board to emit a sound bit stored sequentially after a previously emitted sound bit, whereby the pre-recorded audio sample is emitted when the upper torso sensor is triggered and maintained and the lever switch is repeatedly triggered in concert.

14. The figure according to claim 13 further comprising a lower torso sensor positioned in a lower portion of said torso, the lower torso sensor triggers when the hand attached to the first arm is moved in proximity to said lower torso sensor, wherein said triggering activates a playback of pre-recorded sounds indicative of said lower portion of said lower torso.

15. The figure according to claim 13 further comprising a head having a mouth connected to said torso, the mouth having a head sensor that activates when the hand attached to the first arm is moved in proximity to said head sensor, wherein said triggering activates a playback of pre-recorded sounds indicative of said mouth.

16. The toy figure according to claim 15, wherein the triggering means in the hand is a magnet and the upper torso sensor, lower torso sensor and head sensor are hall-effect sensors.

17. A toy figure having a torso attached to at least a first appendage with an extremity, the figure further comprising:

a plurality of triggering means positioned about the toy figure, a sensor positioned in said extremity, a circuit board to store pre-programmed sounds, a speaker to emit the pre-programmed sounds when the sensor is triggered, the triggering means when in proximity to one of the triggering means in the figure triggers said sensor such that the figure emits a pre-programmed sound.

18. The toy figure of claim 17, wherein the plurality of triggering means are transmitters each programmed to send a specific signal and the sensor is defined as a receiver, and the circuit board is capable of distinguishing the specific signals such that the circuit board plays back pre-recorded sounds related to a transmitter.

* * * * *